United States Patent [19]

Brearley

[11] Patent Number: 4,729,200

[45] Date of Patent: Mar. 8, 1988

[54] SYSTEMS LIMITED

[76] Inventor: David Brearley, 81 Highfield Close, Lower Wortley, Leeds 12, West Yorkshire, England

[21] Appl. No.: 733,286

[22] Filed: May 10, 1985

[30] Foreign Application Priority Data

May 11, 1984 [GB] United Kingdom ..... 8412165

[51] Int. Cl.[4] ..... E04C 3/10

[52] U.S. Cl. ..... 52/223 L; 24/115 G; 24/136 L

[58] Field of Search ..... 52/223 R, 223 L, 230, 52/698, 704; 24/115 R, 115 M, 136 L, 115 G; 294/102.1

[56] References Cited

FOREIGN PATENT DOCUMENTS 3339125 5/1985 Fed. Rep. of Germany .... 52/223 R 2097443 11/1982 United Kingdom ..... 52/223 R

*Primary Examiner*—Carl D. Friedman

*Assistant Examiner*—Naoko N. Slack

*Attorney, Agent, or Firm*—Caesar, Rivise, Bernstein, Cohen & Pokotilow, Ltd.

[57] ABSTRACT

A plug (P) is present in the bore (B) of a wedge gripping device (W) in a barrel (1) of a grip. The device (W) is formed of tapering segments (4) which are held apart by the plug (P). When a length of wire or strand element (E) is received in the device (W), the plug (P) is displaced out of the bore (B) so causing the device (W) to grip the element (E).

4 Claims, 1 Drawing Figure

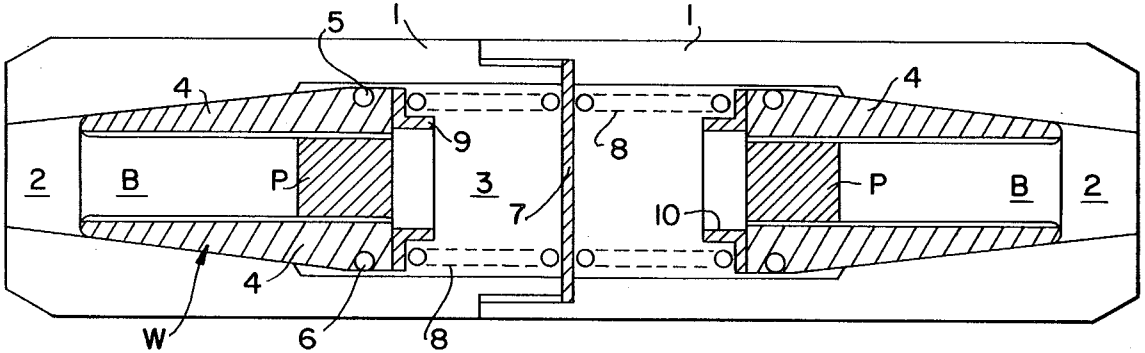
1
1
2
2
3
4
4
4
5
6
7
8
8
9
10
B
B
P
P
W

SYSTEMS LIMITED

The invention relates to an anchor grip of the type useful in tensioning the wires, rods or stranded elements in prestressed concrete structures. Such grips are exemplified by our British Pat. No. 1018967. That patent discloses an anchor grip comprising a body formed with a centre passageway, a wedge device consisting of a plurality of tapered wedge elements arranged adjacent one end of the body and within the passageway, the elements having a bore to receive and engage the wire to be gripped.

It is one object of this invention to provide an anchor grip for the purpose specified, which is more accurate and safe in use.

According to one aspect of the invention there is provided an anchor grip for engaging an end portion of a length of wire or the like, the grip comprising an elongate barrel containing a wedge gripping device, the device comprising a plurality of tapered wedge elements which together define a bore to receive and grip a length of the wire characterised in that a plug is present in the bore to hold the elements apart to ease reception of the wire and is arranged to be displaced from the bore upon reception of the wire.

The invention is applicable to anchor grips of all known types in which the wedge device comprises a number of wedge elements. Thus the grip may be a double ended coupler, or an end grip, which may be open or enclosed. Preferably, the anchor grip is of a double ended type and in a preferred feature the invention provides an anchor grip for engaging an end portion of a length of wire or the like, the grip comprising two elongate barrels each containing a wedge gripping device, each device comprising a plurality of tapered wedge elements which together define a bore to receive and grip a length of the wire the barrels being joined in back to back relation and in threaded interengagement characterised in that a plug is present in the bore of each wedge device to hold the elements apart for ease of reception of the wire and is arranged to be displaced from the respective bore upon reception of the wire.

The plug present in the bore tends to hold the wedge segments open until it is urged out of the bore so that the wire may easily be loaded into the grip by being pushed into the bore and when it displaces the plug a full wedge to wire contact will take place. The plug may be received totally within the bore or a part may extend outside the wider end of the wedge bore into the barrel passageway.

Where the grip is double ended, the operator cannot see within the grip to determine whether an adequate engagement has been made. By virtue of the invention, he cannot engage the wire with the grip until the plug has been displaced so that he cannot make an inadequate connection and therefore does not need to see inside such a grip.

In order that the invention may be well understood, it will now be described with reference to the accompanying diagrammatic drawing, in which FIG. 1 is a sectional view of one anchor grip.

The grip of FIG. 1 comprises a pair of barrels 1 joined together and each having a central passageway comprising a frustoconical portion 2 and a wider diameter cylindrical portion 3. Each barrel contains a respective wedge device W of a known type having a bore B and comprising a number (2, 3 or 4) of tapering wedge segments 4 which at their wider ends are held together by an O-ring 5 received in a groove 6 in the segments. The two barrels are joined together in back-to-back relation by one being threadingly received in the other and a central plate 7 is present in between. A spring 8 is biased at one end against a cap 9 held to the head of the wedge device and at the other end against one side of the plate 7 located between the two barrels. The cap 9 is hollow having a through passageway 10 slightly larger than the bore B of the wedge device W. A safety plug P is receive within the bore B at the wider ends of the segments 4. The plug may be formed of metal or plastic. In use, the operator assembles the grip to the condition shown. He then pushes a wire into one wedge device W until the plug P is urged through the cap 9 into the wider diameter portion 3 of the barrel 1. Because the plug P holds the segments 4 open (which facilitates insertion of the wire), until it has been displaced from the bore B, no wedge-to-wire engagement will take place so long as the plug is still present the wire. When the wire has pushed the plug P out of the bore B, the segments engage the wire W so ensuring a full wedge contact even though the operator cannot see it.

I claim:

1. An anchor grip for engaging an end portion of a length of wire, rod or stranded element, the grip comprising an elongate barrel containing a wedge gripping device, the device comprising a plurality of tapered wedge elements which together define a bore to receive and grip a length of the wire wherein a plug element is present in the bore to hold the wedge elements apart to ease reception of the wire into the bore and is arranged to be displaced from the bore upon reception of the wire.

2. A grip according to claim 1 wherein the plug element is arranged to be displaced from the bore into an adjacent passageway.

3. A grip according to claim 1 wherein a pair of barrels are joined together in end-to-end relation with the wedge devices at the outer ends thereof.

4. A connection of a length of wire, rod or stranded element and a grip wherein the grip is according to claim 1 and the element is received in the bore thereof and engaged by the segments, the plug having been displaced therefrom.

* * * * *